US005192068A

United States Patent [19]

Parker et al.

[11] Patent Number: 5,192,068

[45] Date of Patent: Mar. 9, 1993

[54] SHEET FEEDING AND SEPARATING APPARATUS WITH AN IMPROVED ENTRANCE GUIDE

[75] Inventors: Frank E. Parker, Fairport; Demosthenes K. Kiriazides, Penfield; Joseph S. Vetromile, Rochester; Brian R. Ford, Walworth, all of N.Y.

[73] Assignee: Xerox Corporation, Stamford, Conn.

[21] Appl. No.: 889,575

[22] Filed: May 28, 1992

[51] Int. Cl.[5] ..... B65H 3/04

[52] U.S. Cl. ..... 271/34; 271/121; 271/125

[58] Field of Search ..... 271/34, 121-125

[56] References Cited

U.S. PATENT DOCUMENTS

| | | | |
|---|---|---|---|
| 4,494,744 | 1/1985 | Pouio et al. | 271/34 |
| 4,526,358 | 7/1985 | Ura | 271/34 |
| 4,572,498 | 2/1986 | Shiozawa | 271/34 |
| 4,934,684 | 6/1990 | Gysling | 271/34 |

*Primary Examiner*—Richard A. Schacher

[57] ABSTRACT

A sheet feeding and separating apparatus includes a multiple piece entrance guide located between a stack from which sheets are to be fed and a retard nip. The guide includes a polycarbonate base member, a radiused high friction urethane retard member and a flexible polycarbonate or polyester film deflector member. The urethane is ground to a radius on the leading edge to promote the feeding of down curled sheets, shingling of sheets and the breaking up of slugs prior to entering the retard nip. The deflector member assists in feeding down curled sheets.

5 Claims, 4 Drawing Sheets

SHEET FEEDING AND SEPARATING APPARATUS WITH AN IMPROVED ENTRANCE GUIDE

This invention relates to a sheet feeding and separating apparatus for feeding individual sheets from a stack, and more particularly, to a sheet feeding and separating apparatus that employs an entrance guide located between the sheet stack and retard separator in order to enhance the feeding of a wide variety of sheets.

A major problem associated with sheet feed devices is in feeding papers of varying weights and surface characteristics. With the advent of high speed reproduction machines, the need for sheet feeders to handle a wide variety of sheets without misfeed or multifeed is paramount. However, most sheet feed devices are designed specifically for a particular type or weight of paper having known characteristics. Thus, for example, for feeding virgin sheets upon which copies are to be made into a reproduction machine, the sheet feeders are usually designed specifically for a certain copy paper characteristic. However, in practice, the machine will be exposed to a wide variety of sheets ranging from extremely heavy paper all the way to onion skin. If a feeder is designed to handle the lightest weight paper that may be encountered, in all probability it will not feed heavy stock paper. At the other extreme, if a feeder is designed to handle heavy weight paper there is a possibility that the feeder would severely mutilate light weight paper such as onion skin.

Among problems encountered in feeding lightweight sheets in retard feeders is buckling of sheets between the feed head and retard station and sheets curling behind the retard station. Feeding of down curl paper is a problem in that the paper has a tendency to stub against the entrance guide and then either misfeeds or is nicked. Also, the introduction of recycled paper requires more feeding latitude.

An object of the present invention is to overcome the abovementioned problems by providing an improved entrance guide used in a retard feeder as both a support member and sheet separation gate.

Accordingly, a preferred feature of the present invention is characterized by the use of a multiple piece entrance guide positioned between a sheet feeding member mounted in feeding engagement at an edge of a stack of sheets and a retard nip. The guide consists of a polycarbonate base member, a radiused high friction urethane retard member, and a flexible polycarbonate or polyester film deflector. The urethane is ground on the leading edge to an exact radius to promote the breaking up of slugs of sheets prior to entering the retard nip. The polycarbonate member provides total support for sheets from the stack to the retard nip while the flexible polycarbonate or polyester deflector assist in preventing down curled stock from stubbing on the retard material.

Other features and aspects of the present invention will be apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
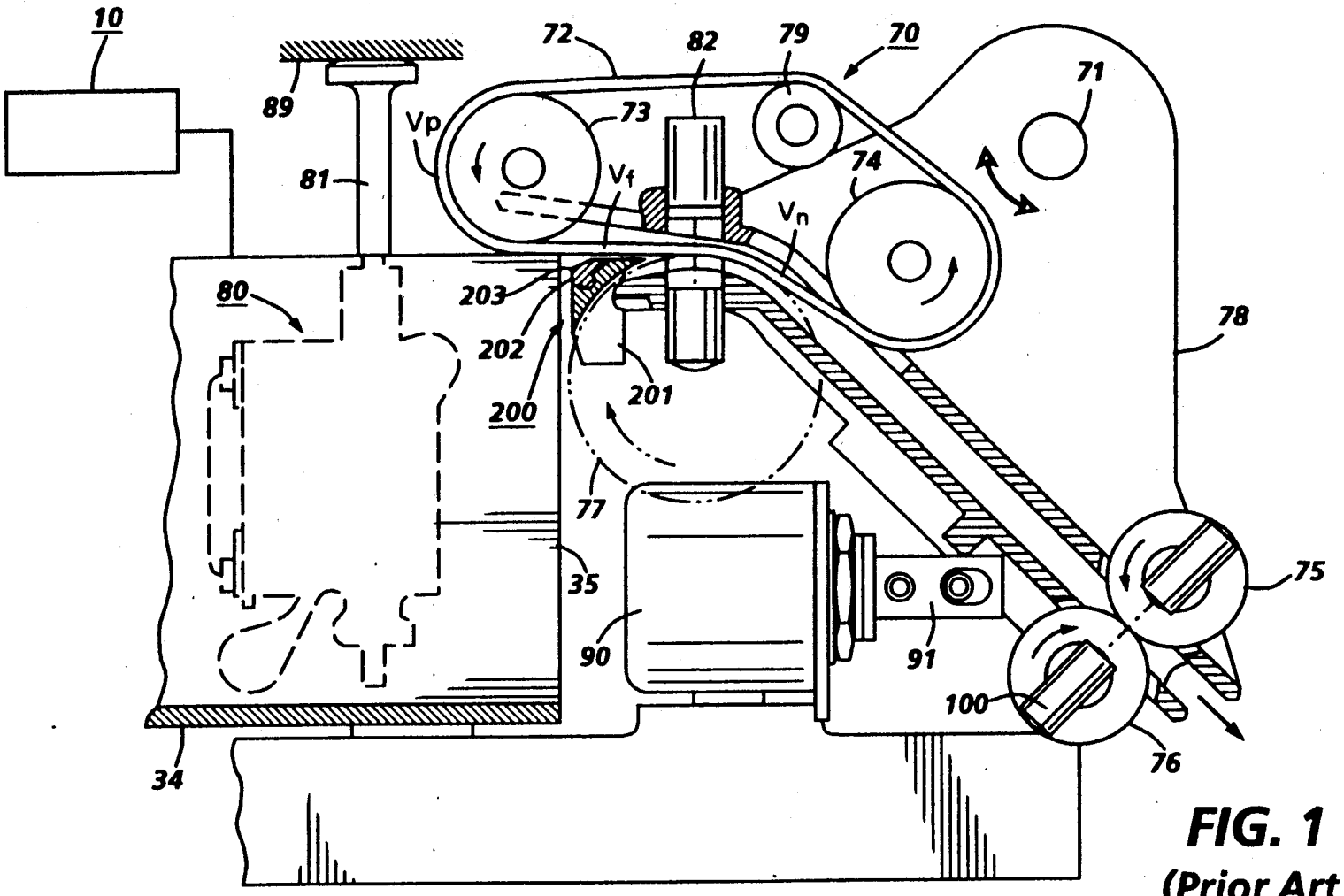
FIG. 1 (Prior Art)
FIG. 1 is a schematic elevational view depicting a prior art entrance guide used in conventional sheet feeding and separating of a copier/printer.

For a general understanding of the features of the present invention, reference is made to the drawings. In the drawings, like reference numerals have been used throughout to designate identical elements. FIG. 1 schematically depicts a copier/printer showing the various components of an illustrative sheet feeding and separating apparatus.

An illustrative prior art feed head mechanism is shown in FIG. 1 as employed in a conventional copier/-printer 10 as shown, for example, in U.S. Pat. No. 4,494,744, which is incorporated herein by reference to the extent necessary to practice the present invention.

With specific reference to FIG. 1, a feed head mechanism 70 is shown which pivots about the feed head pivot point 71. The feed head in this instance is intended to include everything shown with the exception of sensor 80, paper stack 35 and abutment 89. The dynamic normal force is shown as $F_{sn}$. This is a force applied to the paper stack 35 by feed belt 72 due to the feed head balancing around pivot point 71 and the effect of drive torques supplied to the feed head through the pivot point. Belt drives (not shown) transfer power to the feed belt 72 and take-away rolls 75 and 76. The separation capability of the guide is enhanced by controlling the downward force component of the feed belt against the top surface of the guide. This force component is controlled by having feed belt 72 comprise a composition of sufficient tension and bending, stiffness that shingling of sheets at the guide occurs as desired.

In order for feed head mechanism 70 to be able to feed a wide variety of sheets, in addition to entrance guide 200, an initial normal force must be placed on the stack of sheets 35 by feed belt 72 with the normal force being controlled by stack height sensor 80 that allows a wide range of settings within a tight span without binding tendencies. This sensor with stack force relief sensor 82 combines to give feed head 70 automatic stack force adjustments.

When paper is inserted into paper tray 34 and the access door is closed, a motor (not shown) is actuated to raise paper stack 35 which is supported on tray 34 mounted on an elevator (not shown) until plunger 81 of photosensor 80 contacts abutment 89. The sensor is adjusted such that the stack normal force of the idler and belt against the stack 35 is 0.5 lb. when the elevator motor is stopped. This sensor works in conjunction with stack force relief mechanism 70 to provide an automatic two step system of normal force adjustment for the friction retard feeders as shown in FIG. 1.

The normal force between the feeding component and the stack is a critical parameter. If $F_{sn}$ is too large, multifeeding will occur. If $F_{sn}$ is too small, misfeeding will occur. In some feeders, such as this one, a sheet or sometimes a group of sheets are fed to a separation station. If the sheets are in a group or slugs, they are shingled by guide 200. Guide 200 is in multiple pieces and includes a polycarbonate base member 201 and a high friction urethane retard member 202. The multiple piece entrance guide is used as both a support and sheet gate and just touches the feed belt. Urethane retard member 202 is ground beveled on the leading edge 203 to an exact angle to promote breakup of slugs of sheets prior to entering the retard zone. Once the sheet or sheets are in the separation station, stack normal force drive is no longer necessary. At this point it is advantageous to reduce the stack normal force in order to reduce the tendency to drive a second sheet through the separation station formed between feed belt 72 and retard roll 77. To accomplish this end result, a sensor 82 senses the presence of a sheet in the separation station and causes the stack normal force to be reduced through means to be described hereinafter. While feed belt 72 and retard roll 77 are shown in the disclosed embodiment of FIG. 2, it should be understood that a different feed means, such as, a roll, paddle wheel, etc., could replace the belt and be used together with a dual roll retard nip if one desired.

In operation, retard separator mechanism 70 which is mounted on a frame 78 pivots about axis 71 as required. When stack force relief sensor 82 detects the lead edge of a sheet at the retard nip formed between belt 72 and retard roller 77, a machine controller (not shown) actuates solenoid 90 which through retracting plunger 91 pivots frame 78 about axis 71 and lifts the frame slightly. When the solenoid is actuated, the plunger begins to move as soon as its magnetic field has adequately developed. The stack normal could be reduced to zero or lifted completely off the stack if desired, however, for optimum results, the stack normal force is reduced from 0.5 lb. to 0.1 lb. The force in the retard nip will cause the belt to drive the first sheet through the nip and into the take-away rolls 75 and 76. Because the stack normal force has been reduced, i.e., stack force relief has been applied, it should not contribute enough drive force to the second sheet to drive it through the nip, thus reducing the probability of a multifeed. Conversely, if the stack normal force has been reduced and sensor 82 does not detect a sheet every 0.3 second, the controller will deactuate solenoid 90 causing the separator mechanism to assume this original position and thereby increasing the stack normal force to 0.5 lb. in order to feed a sheet from the stack, i.e., the stack force is enhanced. The term sheet is used herein to means substrates of any kind.

This feeder employs independent drives for the feed belt 72 through drive roll 74 and take-away rolls 75 and 76 through drive roll 75. With roll 75 as the drive roll, one clutch is used to drive the feed belt and one clutch is to drive the take-away rolls. A wait sensor 100 is stationed at the take-away roll, i.e., away from the retard roll nip. An early feed belt restart logic is used with this independent drive system. The logic restarts the feed belt (after wait time has elapsed) as soon as there is no paper at the stack normal force relief sensor 82 or as soon as there is no paper at the wait sensor 100, whichever occurs first. The wait sensor is also used as a jam detector.

The paper feeder has a drag brake controlled retard roll 77. The retard brake torque and other feed head critical parameters are selected so that with one sheet of paper through the retard nip the retard roll rotates in the feed direction and with two sheets of paper through the retard nip the roll is fixed.

When paper is present at stack force relief sensor 82 the $F_{sn}$ value is controlled to a low value. When no paper is present at sensor 82 the $F_{sn}$ value is increased. The high value of $F_{sn}$ is defined so that the most difficult paper will feed reliably, i.e., not misfeed. The low value of $F_{sn}$ is defined so that the lightest weight sheets will not be damaged with stack force relief acting. The high and low values of $F_{sn}$ are independent. Sheet buckling could occur whenever the paper is being driven by both the pick off idler 73 and feed retard nip 72, 77. However, whenever that condition exists there is paper present at sensor 82 and the feed belt to sheet coupling at the pick off idler 77 is inadequate to cause lightweight sheet buckling, therefore, light weight sheet buckling will not occur.

Figure 2:
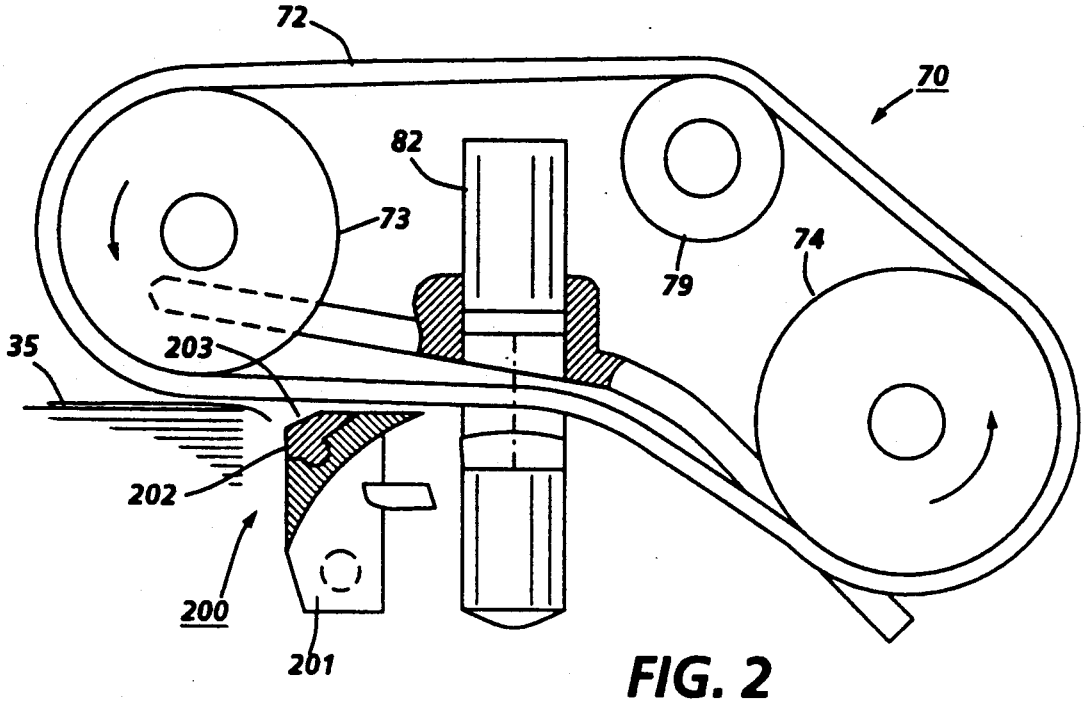
FIG. 2 (Prior Art)
FIG. 2 is an enlarged, partial schematic elevational view showing the entrance guide of FIG. 1 with a beveled edge on the retard material.
Figure 3:
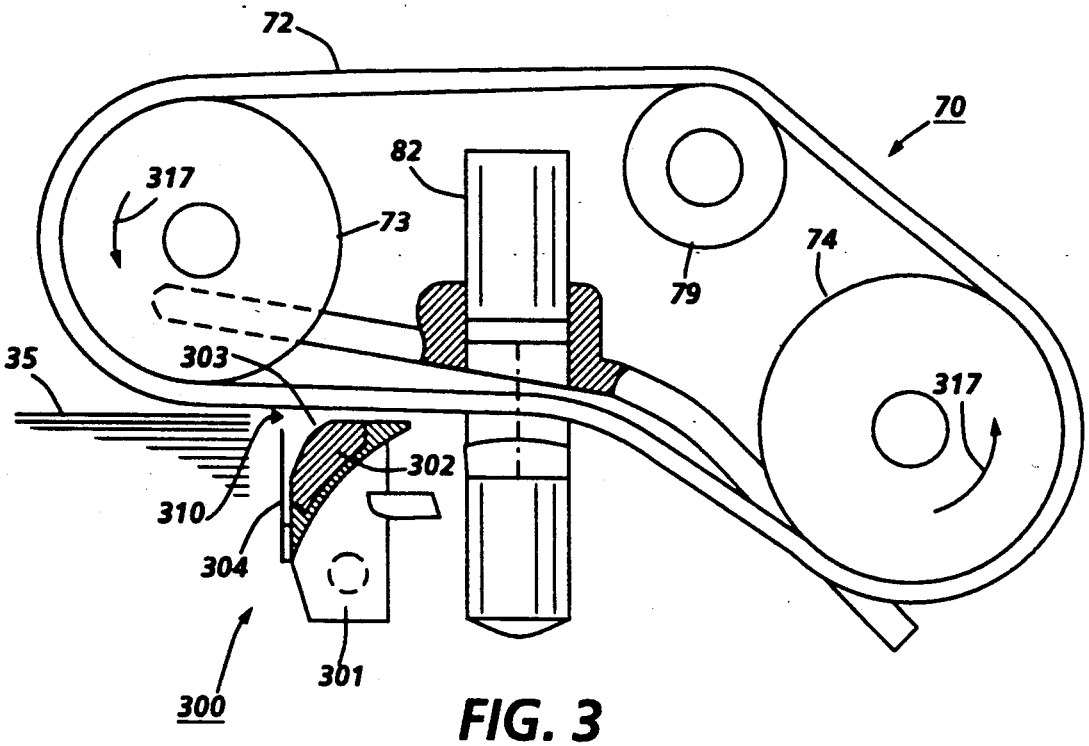
FIG. 3 is an enlarged, partial schematic elevational view showing the improved entrance guide with a radiused retard material of the present invention.
Figure 4:
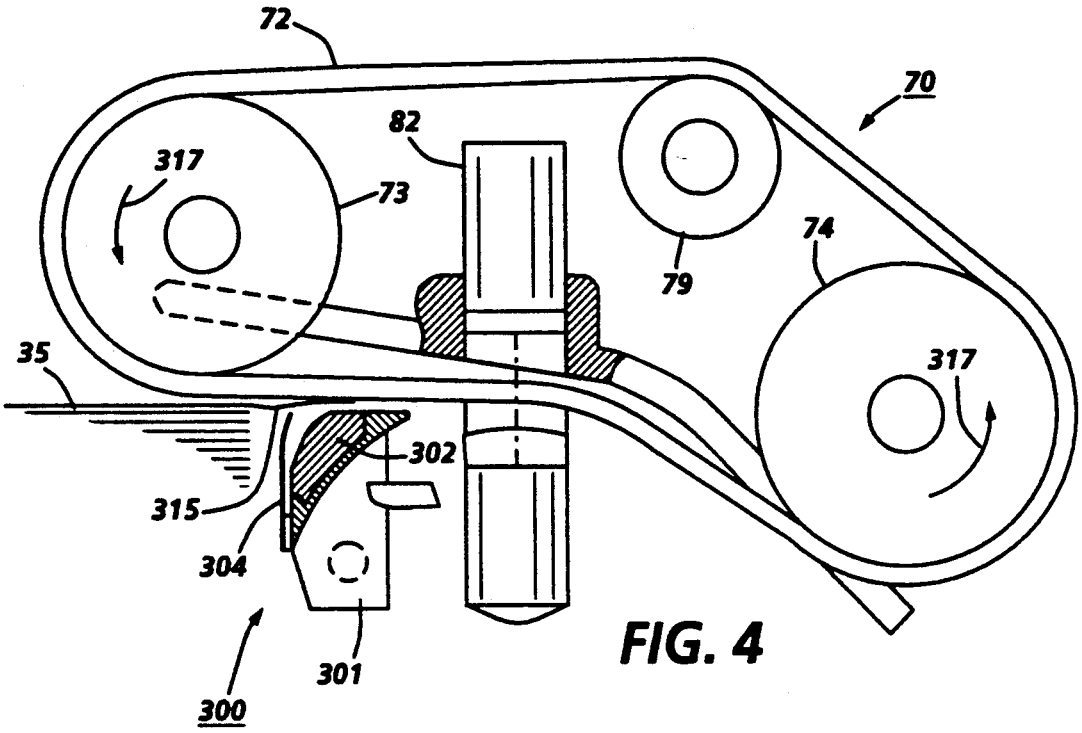
FIG. 4 is an enlarged, partial schematic end view of the improved entrance guide of FIG. 3 showing a sheet being fed.
Figure 5:
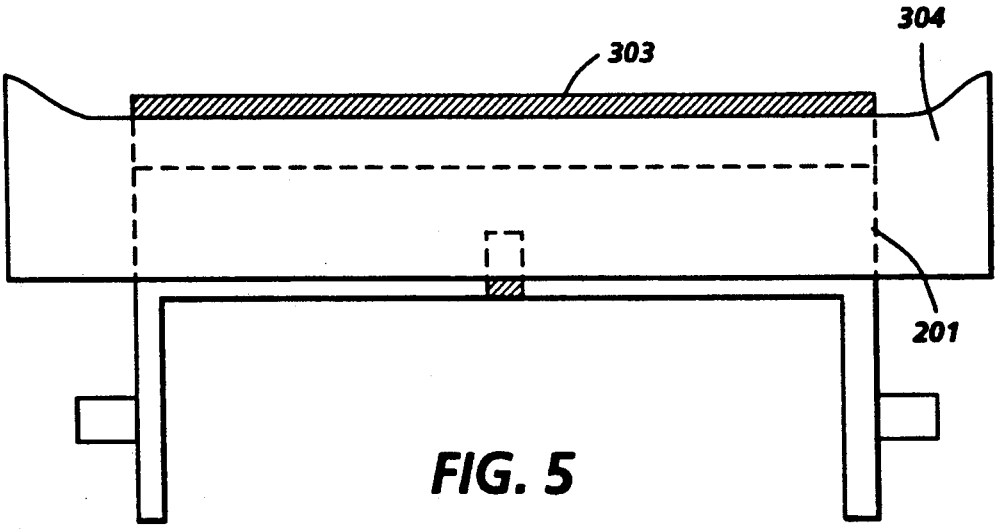
FIG. 5 is a partial and enlarged, schematic end view of the improved entrance guide of FIG. 4 from the left end.

While this feed head is exemplary for most feeding applications, it has been found that down curled paper stubs at the throat 310 and beveled edge 203 of the enter guide 200 in FIG. 2, which causes misfeeds or in some situations the paper is nicked. With customer demand for feeding a wide variety of stock including down curled stock a unique entrance guide in accordance with the present invention is shown in FIGS. 3–6 that replaces entrance guide 200 of FIG. 1. The entrance guide 300 in FIGS. 3–4 includes a polycarbonate base 301, a retard member 302 and a flexible polycarbonate or polyester deflector 304. Retard member 302 has a radiused paper entrance side 303 instead of the beveled entrance 203 of the FIG. 1 retard member 202. This radius increases the opening of the throat 310 and allows down curled stack to enter without stubbing on the edge of the entrance guide. To assist in preventing down curled stock from stubbing on the radiused edge 303 of retard member 302, a flexible polycarbonate or polyester film deflector 304 is provided. The flexible material of deflector 304 extends up into the radiused area of retard member 302 and also overlaps the entrance end of the entrance guide as shown in FIG. 4. Flexible deflector 304 has flared edges as shown in FIG. 5 that assist in guiding sheets over retard member 302. Therefore, as paper 315 from stack 35 is fed by belt 72 of feed head 70 in the direction of arrow 317, the flexible deflector 304 helps reduce the initial feed coefficient of friction and gently lifts the lead edge of the paper as it is driven into the throat 310, thereby preventing stubbing against the radiused area of the retard member.

The flexible polycarbonate or polyester film 304 can also be adapted to extend above the horizontal plane of the polyurethane material 302, as well as, outside the width of support member 301 in order to guide sheets with lead edge down curl into the retard mechanism so as to further suppress incidents/frequency of sheet damage There are numerous advantages obtained by use of the improved entrance guide of the present invention over prior retard systems using entrance guides. For example, the radiused entrance portion of retard member 302 minimizes stubbing of stock thereagainst by increasing the throat area to thereby allow down curled stock to enter the throat area without stubbing against the retard member. Also, the deflector assists in reducing the area of sheet contact of the retard member, as well as, prevents a down curled sheet from stubbing on the edge of the retard material.

Figure 6:
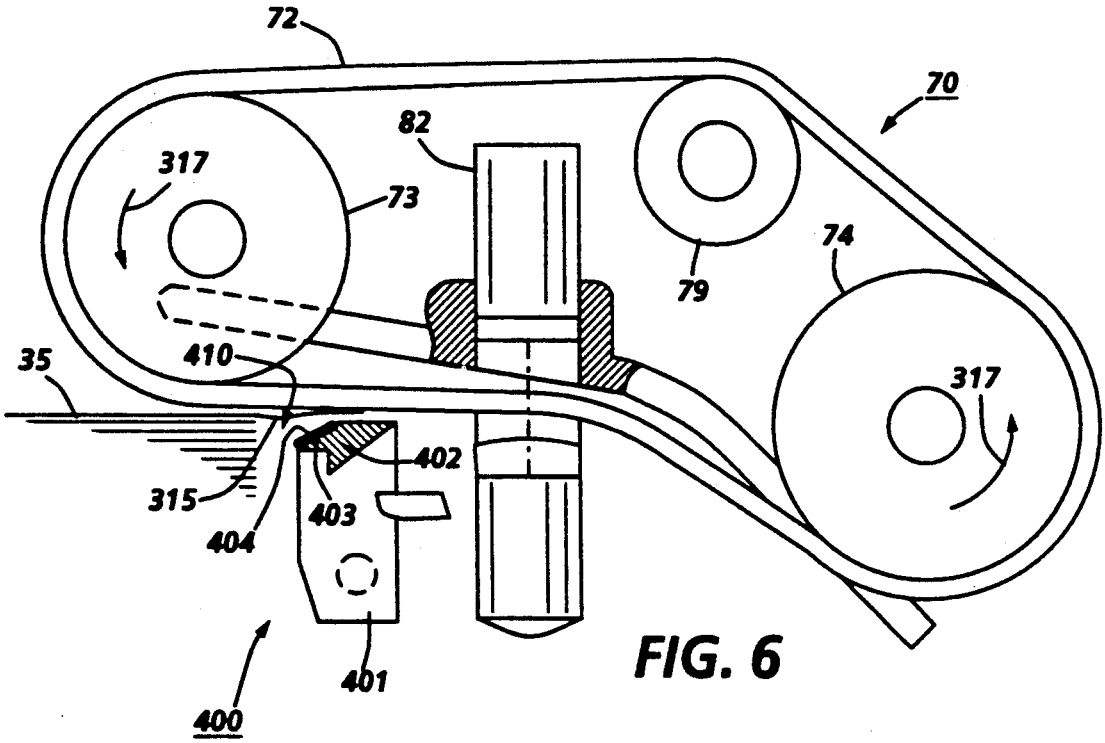
FIG. 6 is an enlarged, partial, schematic of an alternative embodiment of an improved entrance guide in accordance with the present invention.

An alternate embodiment of the improved entrance guide of the present invention is shown in FIG. 6 as 400 and comprises an opened entrance chute 410, as compared to the entrance chute employed in FIG. 2 which is adapted to accept the variation in height of the lead edge of curled sheets as they enter the chute. The entrance chute is formed by the bottom surface of feed belt 72, the portion of urethane retard member 402 that is parallel to feed belt 72 which rotates in the direction of arrow 37 and the beveled edge 403 of retard member 402. A polyester film 404, or the like, is attached to beveled edge 403 at the initial entrance to the sheets to prevent stubbing and damage to the lead edge of the sheets and thereby significantly improve feeder performance. A preferable bevel angle for the entrance guide of FIG. 6 of 38 degrees has an entrance guide material to paper coefficient of 0.23, whereas testing a prior art entrance, guide as in FIGS. 1 and 2, for the same bevel angle yielded an entrance guide material to paper coefficient of 0.90.

In conclusion, it should be apparent from the foregoing that a retard feeder has been disclosed that includes a multiple piece entrance guide as a critical element thereof. The guide is essential to the feeder's capability of feeding down curled sheets and breaking up and shingling slugs of sheets before they reach the retard nip and of feeding a wide variety of sheets and comprises a radiused elastomer covering on the paper guiding surface of the guide and a polycarbonate base member. The elastomer controls the friction to avoid providing extra driving force to a second sheet. Also, the guide is placed very close to the retard member in order to provide complete support for a sheet from the stack to the retard nip to thereby avoid the curling of lightweight sheets behind the retard roll. A flexible deflector is positioned to be contacted by a sheet leaving the stack before the sheet reaches the guide. The flexible deflector has the dual purpose of reducing the initial coefficient of friction necessary to feed the sheet from the stack and prevents the sheet from stubbing on the sheet contacting face of the retard member, thereby enhancing the ability of the separator feeder to feed sheets of varying weights from the stack.

What is claimed is:

1. A sheet feeding and separating apparatus for feeding and separating sheets individually from a stack of sheets, comprising:

tray means for holding the stack of sheets, said tray means includes elevator means that lifts any sheet to be fed from said tray means to a feeding position above the confines of said tray means so that the sheets in the stack are initially unobstructed as they are fed from the stack;

endless feed belt means mounted in sheet feeding engagement with the top of the stack of sheets and applying a normal force thereto;

said feed belt means being rotatably mounted between spaced supports to provide a deformable unsupported section therebetween;

a retard roll having a curvilinear portion thereof deformably engaging said feed belt means to form a nip therebetween for separating any overlapped sheets reaching the nip; and an integrally molded stationary multiple piece entrance guide positioned between said retard roll and said tray means such that said entrance guide is the first obstruction sheets being fed by said feed belt means encounter en route to the nip formed between said retard roll and said feed belt means, said entrance guide includes a high friction urethane first portion with a radiused edge that serves to shingle slugs of sheets and a polycarbonate second portion that supports said first portion, said polycarbonate second portion having an elongated third portion that is cantilevered, said elongated third portion includes an upper surface that terminates at a sharp edge and extends to a position immediately adjacent said curvilinear portion of said retard roll and works in conjunction with an upper surface of said high frictional urethane first portion to support sheets the entire distance from the stack into said curvilinear portion of said retard roll to prevent lightweight sheets from causing jams at the nip formed between said retard roll and said feed belt means, and a flexible deflector means for assisting in reducing the initial feed coefficient of friction and preventing down curled sheets from stubbing on said first portion of said entrance guide.

2. The sheet feeding and separating apparatus of claim 1, wherein said flexible deflector means comprises a polycarbonate material.

3. The sheet feeding and separating apparatus of claim 1, wherein said flexible deflector means comprises a polyester film.

4. A sheet feeding and separating apparatus for feeding and separating sheets individually from a stack of sheets, comprising:

tray means for holding the stack of sheets, said tray means includes elevator means that lifts any sheet to be fed from said tray means to a feeding position above the confines of said tray means so that the sheets in the stack are initially unobstructed as they are fed from the stack;

endless feed belt means mounted in sheet feeding engagement with the top of the stack of sheets and applying a normal force thereto;

said feed belt means being rotatably mounted between spaced supports to provide a deformable unsupported section therebetween;

a retard roll having a curvilinear portion thereof deformably engaging said feed belt means to form a nip therebetween for separating any overlapped sheets reaching the nip; and an integrally molded stationary multiple piece entrance guide positioned between said retard roll and said tray means such that said entrance guide is the first obstruction sheets being fed by said feed belt means encounter en route to the nip formed between said retard roll and said feed belt means, said entrance guide includes a high friction urethane first portion with a beveled edge that serves to shingle slugs of sheets and a polycarbonate second portion that supports said first portion, said polycarbonate second portion having an elongated third portion that is cantilevered, said elongated third portion includes an upper surface that terminates at a sharp edge and extends to a position immediately adjacent said curvilinear portion of said retard roll and works in conjunction with an upper surface of said high frictional urethane first portion to support sheets the entire distance from the stack into said curvilinear portion of said retard roll to prevent lightweight sheets from causing jams at the nip formed between said retard roll and said feed belt means, said beveled edge includes a means secured thereto for assisting in reducing the initial feed coefficient of friction and preventing down curled sheets from stubbing on said first portion of said entrance guide.

5. The sheet feeding and separating apparatus of claim 4, wherein said means for assisting in reducing the initial feed coefficient of friction is a polyester material.

* * * * *